US009611701B2

(12) United States Patent
Gylling

(10) Patent No.: US 9,611,701 B2
(45) Date of Patent: Apr. 4, 2017

(54) METHOD AND APPARATUS FOR PLASTIC PIPE DRILLING

(71) Applicant: Oy Atlas Copco Rotex Ab, Tampere (FI)

(72) Inventor: Kai Gylling, Tampere (FI)

(73) Assignee: OY ATLAS COPCO ROTEX, Tampere (FI)

( * ) Notice: Subject to any disclaimer, the term of this patent is extended or adjusted under 35 U.S.C. 154(b) by 410 days.

(21) Appl. No.: 14/360,765

(22) PCT Filed: Oct. 30, 2012

(86) PCT No.: PCT/FI2012/051040

§ 371 (c)(1),
(2) Date: May 27, 2014

(87) PCT Pub. No.: WO2013/076360

PCT Pub. Date: May 30, 2013

(65) Prior Publication Data

US 2014/0332276 A1 Nov. 13, 2014

(30) Foreign Application Priority Data

Nov. 25, 2011 (FI) ..... 20116180

(51) Int. Cl.
*E21B 7/20* (2006.01)
*E21B 17/00* (2006.01)
(Continued)

(52) U.S. Cl.
CPC ..... *E21B 17/00* (2013.01); *E21B 7/20* (2013.01); *E21B 7/28* (2013.01); *E21B 10/40* (2013.01); *E21B 17/04* (2013.01); *E21B 17/14* (2013.01)

(58) Field of Classification Search
CPC ..... E21B 7/20
(Continued)

(56) References Cited

U.S. PATENT DOCUMENTS 5,542,483 A * 8/1996 Edman ..... E21B 7/20 175/257
5,813,484 A * 9/1998 Ekstrom ..... E21B 7/208 175/293
5,964,297 A * 10/1999 Edman ..... E21B 7/20 166/242.8

FOREIGN PATENT DOCUMENTS

WO WO-9317215 A1 9/1993
WO WO-9529321 A1 11/1995
(Continued)

OTHER PUBLICATIONS

PCT/ISA/210—International Search Report—Feb. 21, 2013 (Issued in Application No. PCT/FI2012/051040).
(Continued)

*Primary Examiner* — Giovanna C Wright
(74) *Attorney, Agent, or Firm* — Venable, LLP

(57) ABSTRACT

A drilling method and apparatus. A drilling device includes a plastic casing part and a drilling unit arranged essentially inside the casing part. The drilling unit includes a first drilling part for drilling a center hole and a second drilling part for reaming the center hole for the casing part. The drilling parts are arranged at a drilling head. The drilling parts are coupled in a power transmitting manner or in a radially contractable manner in connection with the casing part. A casing shoe is mounted at an end of the casing part. In coupling of the casing shoe at an end of the casing part, a casing shoe is used that includes a working member. The casing shoe is mounted at the end of the casing part by treating the casing part to provide a joint between the casting part and the casing shoe that transmits pulling.

8 Claims, 8 Drawing Sheets

(51) Int. Cl.

| | |
|---|---|
| ***E21B 7/28*** | (2006.01) |
| ***E21B 10/40*** | (2006.01) |
| ***E21B 17/04*** | (2006.01) |
| ***E21B 17/14*** | (2006.01) |

(58) Field of Classification Search
USPC ..... 175/22, 257
See application file for complete search history.

(56) References Cited

FOREIGN PATENT DOCUMENTS

| | | |
|---|---|---|
| WO | WO-9706337 A1 | 2/1997 |
| WO | WO-2009038513 A1 | 3/2009 |

OTHER PUBLICATIONS

PCT/ISA/237—Written Opinion of the International Seraching Authority—Feb. 21, 2013 (Issued in Application No. PCT/FI2012/051040).
PCT/IPEA/408—Written Opinion of the International Preliminary Examining Authority—Nov. 20, 2013 (Issued in Application No. PCT/FI2012/051040).
PCT/IPEA/409—International Preliminary Report on Patentability—Feb. 26, 2014 (Issued in Application No. PCT/FI2012/051040).

* cited by examiner

METHOD AND APPARATUS FOR PLASTIC PIPE DRILLING

CROSS-REFERENCE TO RELATED APPLICATIONS

This application claims priority to Finnish patent application 20116180 filed 25 Nov. 2011 and is the national phase of PCT/FI2012/051040 filed 30 Oct. 2012.

FIELD OF THE INVENTION

The invention relates to the method and apparatus for plastic pipe drilling according to the independent claims related thereto.

BACKGROUND OF THE INVENTION

Regarding applications for use of so called plastic pipe drilling typically e.g. well drilling or e.g. forepoling come into question. An advantage of use of a plastic pipe in drilling is first of all the fact that plastic pipes are very light compared to steel pipes, thanks to which they also have more profitable transport costs and they are easier to handle at a construction site. Furthermore a plastic pipe is significantly cheaper than a corresponding steel pipe. A plastic pipe does not frost for that matter and when being mounted into the ground, it does not break the bits of crushers or drills, when the soil is later on being e.g. worked or drilled. Furthermore in caves or quarries, metal may not blend with broken rocks, which is why use of plastic pipes in drilling has a very remarkable meaning in that context as well.

Today significant problems are, however, related to plastic pipe drilling, which is why it is not possible to exploit the same to the extent that there is a need for or that there are possibilities in practice. This is among other things due to the fact that the present arrangements require first of all use of a steel pipe in the beginning of drilling, whereby it is only after that possible to start using in the drilling a plastic pipe to be coupled with the steel pipe e.g. by a screw joint and after that further plastic pipes to be coupled with each other one after the other. On the other hand solutions are being used, which are based on a screw joint coupling between a plastic pipe with a readymade threading and a casing shoe.

The former solution is not satisfactory first of all due to the fact that there is still a need for use of a steel pipe in the starting phase, whereby it is possible to exploit plastic pipes with preworked threadings only after the above phase. Use of plastic pipes with readymade threadings has, however, found out to be very difficult in practice, because a threaded part of a plastic pipe being coupled with a casing shoe made of steel easily gets cut due to differences in shapes of mutual threadings in the parts in question. The problems related to preworked threadings in plastic pipes are probably due to the differences of steel and plastic e.g. because of strength and thermal expansion characteristics thereof and the like reasons.

There have been efforts for exploitation of joint arrangements in plastic pipes with readymade threadings on the other hand by using a very long coupling stem in the casing shoe with necessary elasticity means, such as damping O-rings, despite of which a screw joint between a casing shoe and a plastic pipe to be carried out with reasonable costs has not been managed to accomplish so far. All the types of arrangements described above require rather massive arrangements in order to make sure a screw joint between the casing shoe and the plastic pipe, which is why they increase the manufacturing costs disproportionately and make use of the solutions in question significantly more difficult in installation work in practice.

SUMMARY OF THE INVENTION

It is an aim of the present method and apparatus for plastic pipe drilling to achieve a decisive improvement in the problems described above and thus to raise essentially the level of prior art. In order to carry out this aim, the method and apparatus according to the invention are mainly characterized by what has been presented below.

As the most important advantages of the method and apparatus according to the invention may be mentioned simplicity and efficiency of constructions and use enabled by the same first of all thanks to the fact that a mechanical joint between a casing shoe and a plastic pipe can be formed in a reliable manner during coupling thereof by mechanically working the casing part, such as by threading the same at the same time as the casing shoe is being installed on the plastic pipe. Thanks to the invention it is thus possible to exploit an unpreworked plastic pipe which e.g. comes so to say directly from a production line, and that does not require any kind of additional machining, such as e.g. a preworked threading, which is the case with the solutions according to present technique. Furthermore thanks to the invention the joint between the casing shoe and the plastic pipe becomes totally clearance free even when using a significantly shorter coupling stem in the casing shoe than being used presently, and the joint is not diverted to varying of load in the longitudinal direction of the screw joint, which is typical in coupling of plastic material and steel material with readymade threadings with each other by a screw joint. Thanks to the invention, in the plastic pipe drilling there is no need for exploiting a steel pipe in the beginning, either, nor an excessively long casing shoe for that matter, which for its part eliminates a risk of metal, which may break bits of crushers or drills, from getting drifted into the soil.

By the method and apparatus according to the invention it is thus possible to make economical productivity of drilling significantly more efficient thanks to lowering transportation costs and easier handling of the plastic pipes. By virtue of the invention it is furthermore possible to exploit use of e.g. food stuff plastics in a more effective manner than at present e.g. in well drilling, thanks to which drill wells can be made as long lasting as possible without a risk of the earth pipes being used to get rosted.

Other advantageous embodiments of the method and apparatus according to the present invention have been presented below.

BRIEF DESCRIPTION OF THE DRAWINGS

In the following description the invention is being illustrated in detail with reference to the appended drawings, in which FIG. 1*a* illustrates the casing shoe and the casing part prior to coupling thereof, FIG. 1*b* illustrates the casing shoe and the casing part during coupling thereof, and FIG. 1*c* illustrates the casing shoe fully coupled to the casing part;

DETAILED DESCRIPTION OF EMBODIMENTS OF THE INVENTION

Figure 1A:
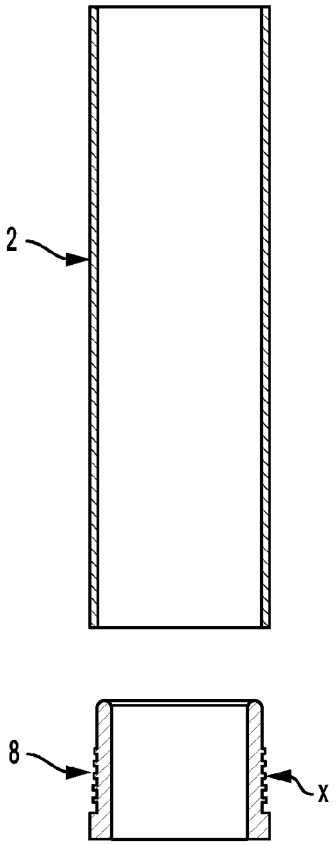
FIGS. 1*a*, 1*b*, and 1*c* show a process of coupling of a casing shoe with a plastic pipe acting as a casing part, where
Figure 1B:
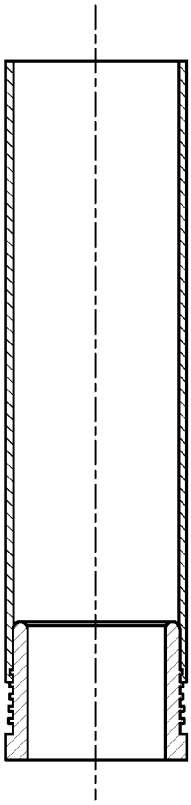
Figure 1C:
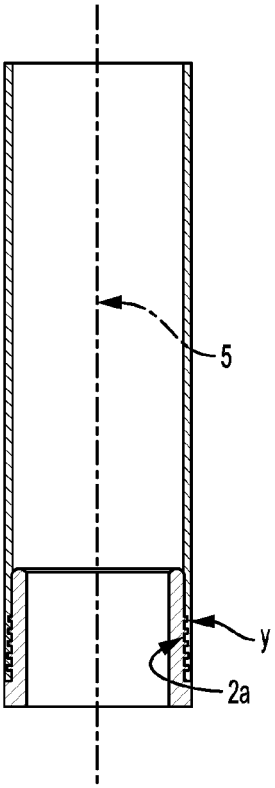
Figure 2C:
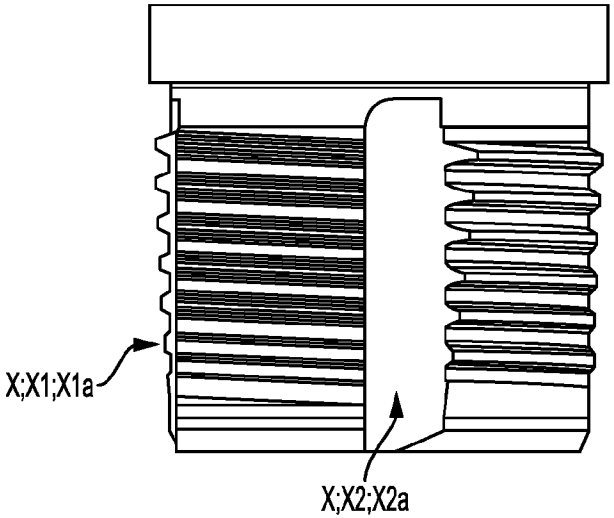
FIG. 2*c* shows a side view of the casing shoe according to one embodiment.
Figure 2B:
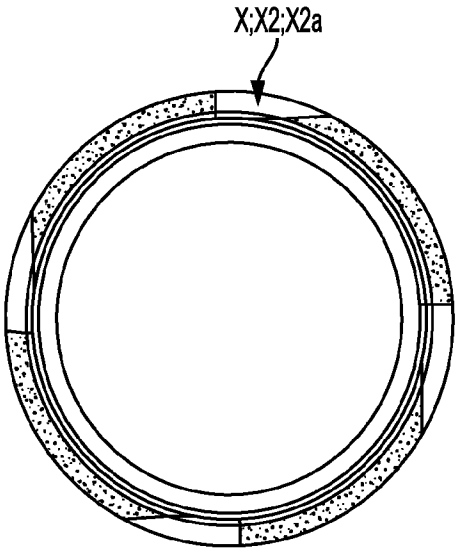
FIG. 2*b* shows a front view of the casing shoe.
Figure 2A:
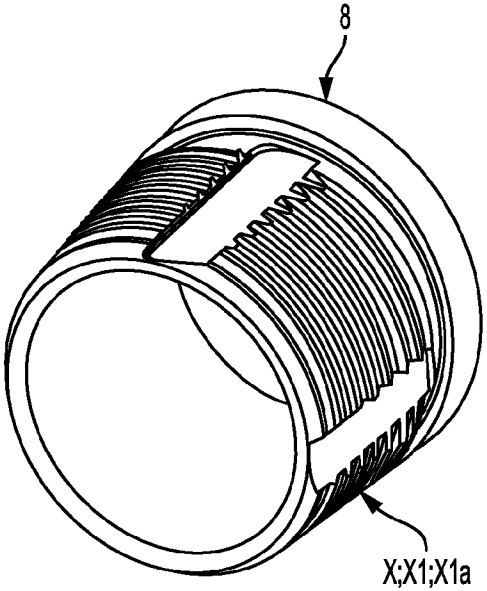
FIG. 2*a* shows a perspective view of the casing shoe.

The invention relates first of all to a method for plastic pipe drilling when using an apparatus e.g. of the type as shown in FIGS. 3*a*, 3*b*, 6 and 7, which has a drilling device 1 that consists of a casing part 2 manufactured from a plastic based material particularly for performing plastic pipe drilling and a drilling unit 3 that exists at least during a drilling situation essentially inside the above, which unit includes first drilling means 4 for drilling a center hole and second drilling means 5 for reaming the center hole for the casing part 2, the means 4, 5 existing at a drilling head I of the drilling unit. The drilling means 4, 5 are coupled mutually on the first hand at least during a drilling situation in a power transmitting manner in order to carry out cooperation thereof for a rotational motion, a feeding motion and/or a hammering motion, and on the other hand removably or in a radially contractable manner in connection with the casing part 2 in order to enable removal of the first drilling means 4 or the second drilling means 5 together with the same from a drilled hole. A casing shoe 8 is being mounted at an end of the casing part 2 for pulling of the casing part 2 into the hole to be drilled by the drilling unit 3 through the casing shoe 8. In coupling of the casing shoe 8 at an end of a casing part 2, a casing shoe 8 is being used that is provided with working means X, whereby the casing shoe 8 is being mounted at the end of the casing part 2 on the principle according to the pictorial shown in FIGS. 1*a*-1*c* by treating the same in order to achieve a joint Y between the said parts 2, 8 that transmits pulling in a longitudinal direction s of the drilling unit 3.

As an advantageous embodiment of the method it is exploited when using a drilling apparatus, in which the drilling head I of the drilling unit 3 is formed of a first frame part 4*a* and a second frame part 5*a*, wherein drilling surfaces P1, P2 formed of end surfaces of the above frame parts are provided with drilling organs of the first and the second drilling means 4, 5, such as an integrated drilling part, separate drilling pieces, bits or like. The casing shoe 8 for its part is connectable with the second frame part 5*a* when needed by a joint arrangement L that enables a mutual rotative motion of the casing shoe 8 and the second frame part 5*a* and that limits mutual longitudinal movement of casing shoe. With reference to the advantageous embodiments as shown e.g. in FIGS. 2*a*-2*c*, 4*a*, and 4*b*, a casing shoe 8 with a threading end X1 having two or several ends and an exhaust arrangement X2 for removal of chips, is being used in mounting of the casing shoe 8 at the end of the casing part 2 for achieving a screw joint between said parts 2, 8 through chipping.

Furthermore as an advantageous embodiment of the method, in forming an internal or external joint surface 2*a* with respect to the casing part 2, an internal or external threading sleeve X1*a*, X1*b* is being exploited that is arranged in an integral manner at the end of the casing shoe 8, the sleeve having one or more chip removal grooves X2*a* or openings X2*b*.

As a further advantageous embodiment particularly according to FIGS. 1*a*-1*c*, 2*a*-2*c*, 3*a*, 3*b*, and 6, in the mounting of the casing shoe 8 at the end of the casing part 2, working means X are being used that perform chipping on cone screw principle by exploiting as a further advantageous embodiment a threading end X1 in the casing shoe 8 that is carried out by a machine thread, a square thread, a trapezoidal thread and/or a like.

As a further advantageous embodiment of the method, an essentially unpreworked raw pipe preform is being used as the casing part 2 that is manufactured particularly for food stuff utilization preferably from PEH-, PVC-plastic or a like and/or from reinforced plastic, such as fibrereinforced plastic or a like.

On the other hand, the invention also relates to an apparatus e.g. according to the type as shown in FIGS. 3*a*, 3*b*, 6 and 7 for plastic pipe drilling, which has a drilling device 1 that consists of a casing part 2, manufactured from a plastic based material particularly for performing plastic pipe drilling and a drilling unit 3 that exists at least during a drilling situation essentially inside the above, which unit includes first drilling means 4 for drilling a center hole and second drilling means 5 for reaming the center hole for the casing part 2, the means 4, 5 existing at a drilling head I of the drilling unit. The drilling means 4, 5 are being coupled mutually on the first hand at least during a drilling situation in a power transmitting manner in order to carry out cooperation thereof for a rotational motion, a feeding motion and/or a hammering motion and on the other hand removably or in a radially contractable manner in connection with the casing part 2 in order to enable removal of the first drilling means 4 or the second drilling means 5 together with the same from a drilled hole. A casing shoe 8 is arranged to be mounted at an end of the casing part 2 for pulling of the casing part 2 into the hole to be drilled by the drilling unit 3 through the casing shoe 8. With reference to the advantageous embodiments shown e.g. in FIGS. 2*a*-2*c*, 4*a*, and 4*b*, the casing shoe 8 is provided with working means X in order to couple the same on the principle manifesting itself from FIGS. 1*a*-1*c* at an end of the casing part 8 by treating the casing part, in order to achieve a joint Y between the said parts 2, 8 that transmits pulling in a longitudinal direction s of the drilling unit 3.

As an advantageous embodiment of the apparatus according to the invention, in the type implementations as shown e.g. in FIGS. 3*a*, 3*b*, 5, 6 and 7, in which the drilling head I of the drilling unit 3 is formed of a first frame part 4*a* and a second frame part 5*a*, wherein drilling surfaces P1, P2 formed of end surfaces of the above frame parts are provided with drilling organs of the first and the second drilling means 4, 5, such as an integrated drilling part, separate drilling pieces, bits or like. Particularly with reference to FIGS. 3*b*, 5 and 6, the casing shoe 8 is connectable when needed directly by means of a skirt part 8*a* existing therewith (FIG. 3*b*) or by means of an intermediate ring (FIGS. 5 and 6) with the second drilling means 5 or the reamer by a joint arrangement L that enables rotative motion of the casing shoe 8 with respect to the reamer and that limits longitudinal movement of the casing shoe.

Figure 3A:
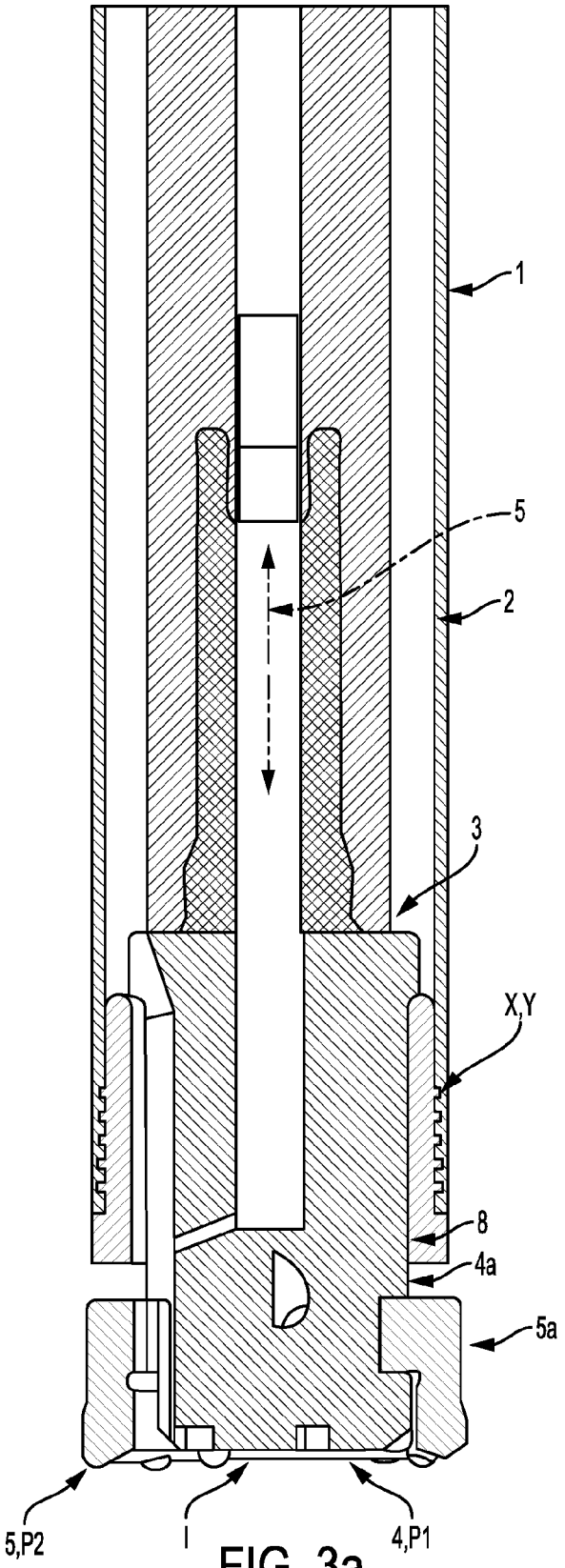
FIG. 3*a* shows an apparatus for plastic pipe drilling having one type of casing show and FIG. 3*b* shows the apparatus for plastic pipe drilling having another type of casing show.
Figure 3B:
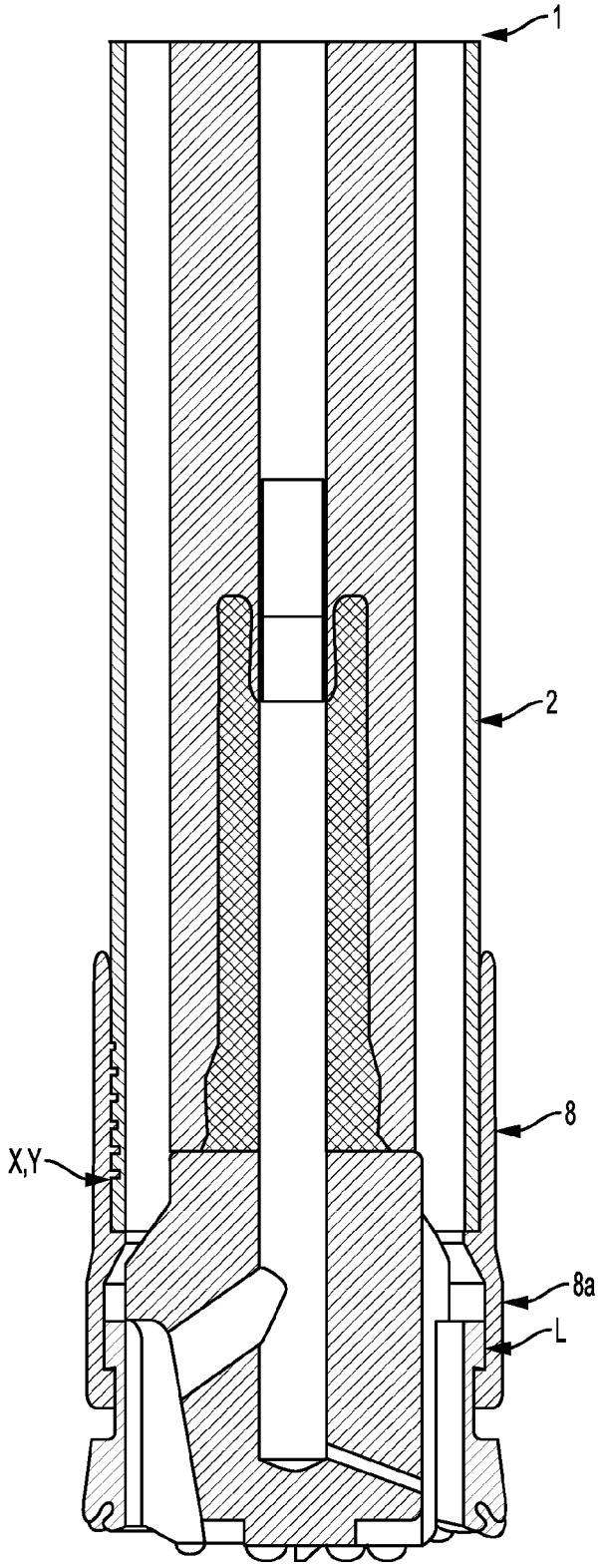
Figure 4A:
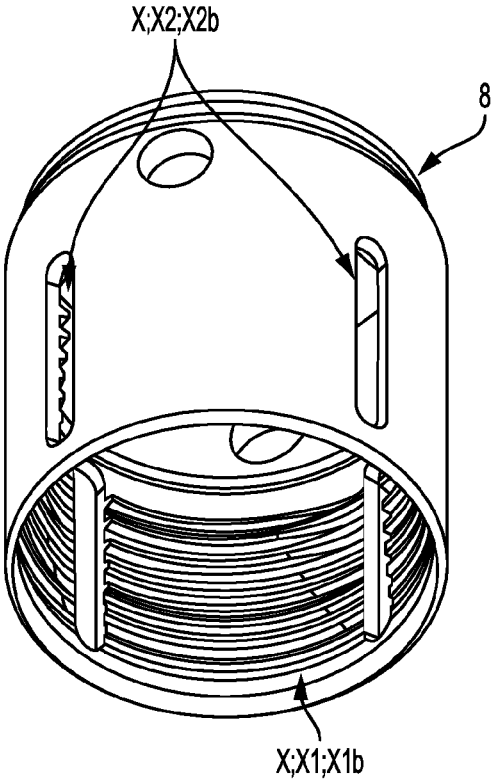
FIG. 4*a* shows a perspective view of a casing shoe, which is configured to externally couple with a plastic pipe acting as a casing part, according to, an embodiment alternative to the one shown in FIGS. 2*a*-2*c;*
Figure 4B:
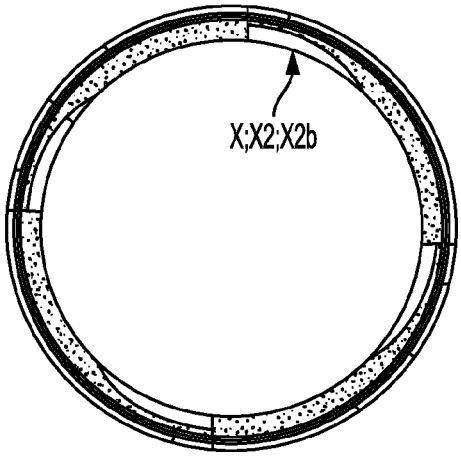
Figure 5:
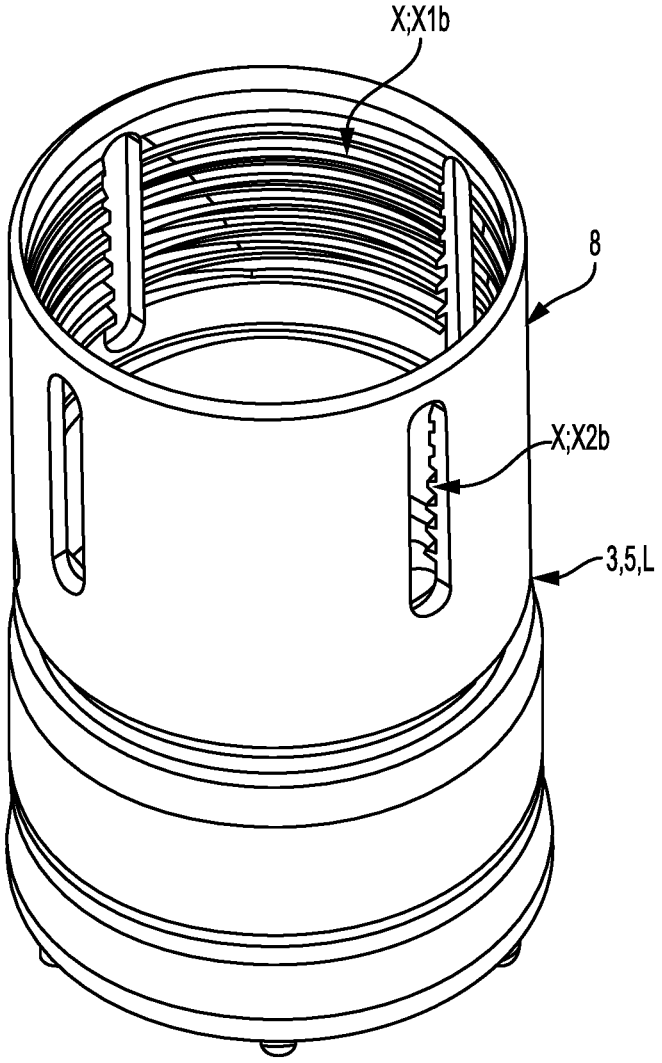
FIG. 5 shows as a perspective view of the casing shoe illustrated in FIGS. 4*a* and 4*b*, which is coupled with a symmetrical drilling unit.
Figure 6:
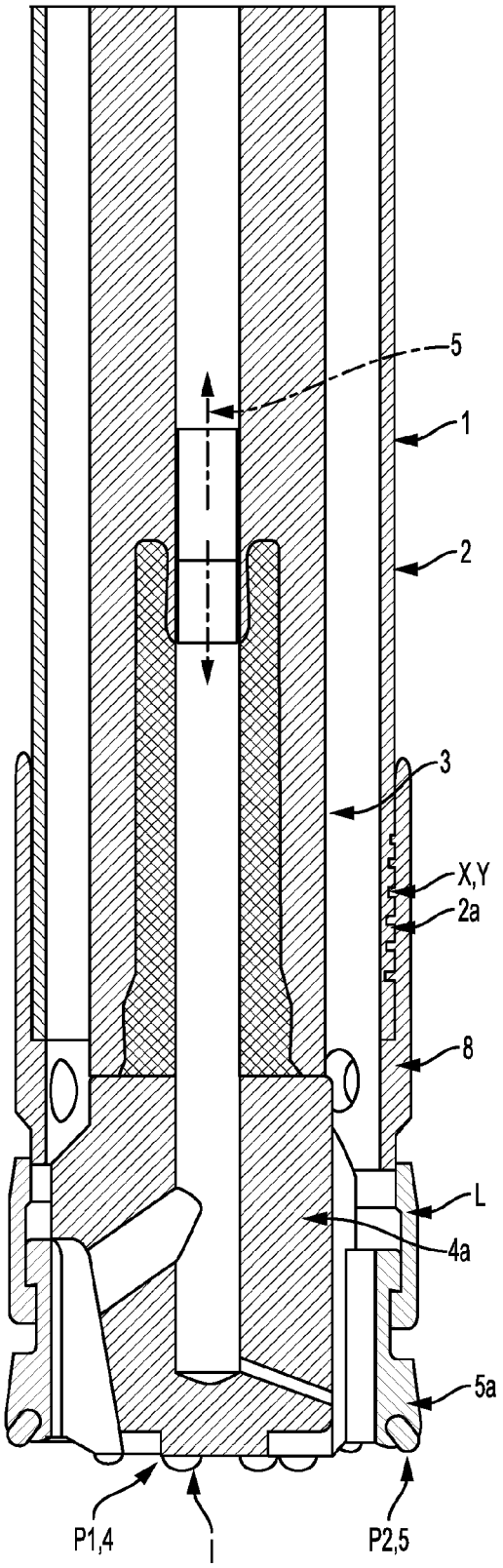
FIG. 6 shows a longitudinal cross sectional view of a symmetrical drilling unit in connection with the casing shoe as shown in FIGS. 4*a* and 4*b*.
Figure 7:
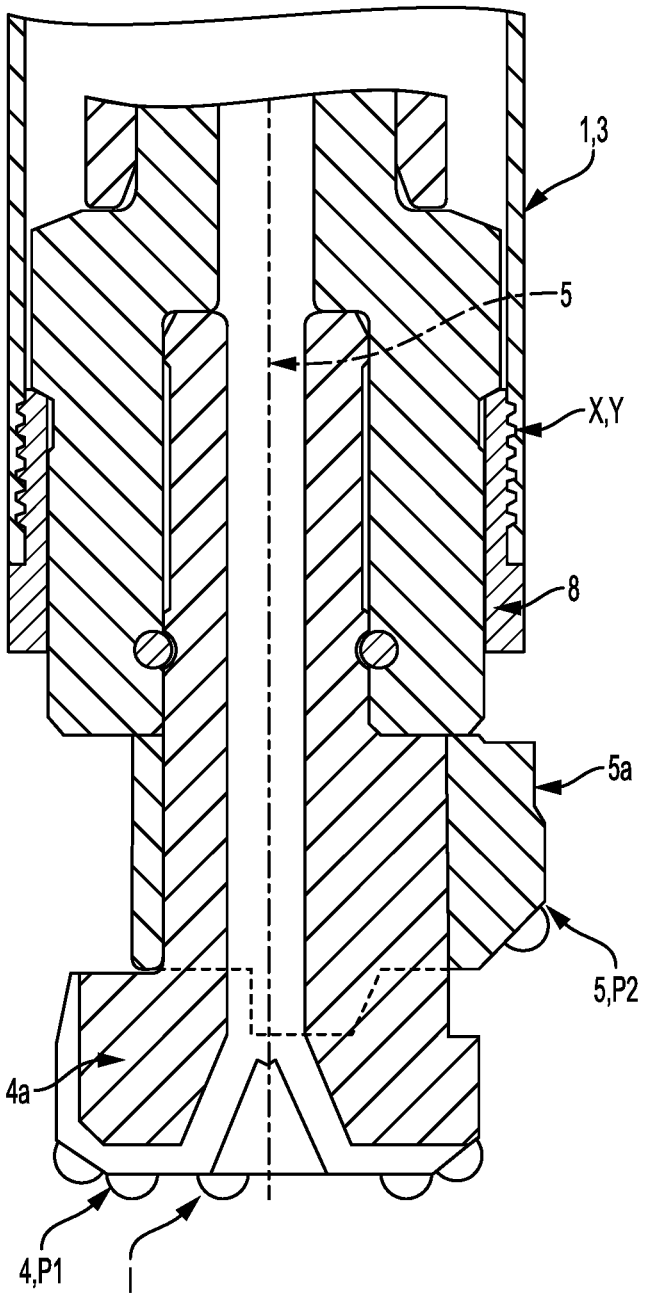
FIG. 7 shows a longitudinal cross sectional view of an asymmetrical drilling unit in connection with a casing shoe that is installed according to the invention internally with a plastic pipe acting as the casing part.

In FIG. 3*b* the skirt part 8*a* unites with the reamer externally in the radial direction, but it can naturally also be carried out by an internal coupling with the reamer. In the embodiments shown in FIGS. 3*a* and 7 the casing shoe 8 is coupled at the end of the casing part, but without a contact with the reamer 5.

In a further advantageous manner, the casing shoe 8 is provided with a threading end X1 with two or several ends in order to mount the casing shoe 8 at the end of the casing part 2 for achieving a screw joint between said parts through chipping, whereby the threading end X1 is provided with exhaust arrangements X2 for removal of chips.

Particularly in the advantageous embodiment shown in FIGS. 2*a*-2*c*, 4*a*, and 4*b*, the end of the casing shoe 8 is provided in an integral manner with an internal or external threading sleeve X1*a*, X1*b*, in order to form an internal or external joint surface 2*a* with respect to the casing part 2, whereby the threading sleeve comprises one or more chip removal grooves X2*a* or openings X2*b*.

As a further advantageous implementation, the threading end X1 of the casing shoe 8 comprises a machine thread, a square thread, a trapezoidal thread and/or a like. Correspondingly the casing part 2 comprises profitably an essentially unpreworked raw pipe preform, which is manufactured particularly for food stuff utilization preferably from PEH-, PVC-plastic or a like and/or from reinforced plastic, such as fibrereinforced plastic or a like.

It is clear that the invention is not limited to the embodiments shown or described above, but instead it can be modified within limits of the basic idea of the invention according to the operating purposes and needs at any given time. It is thus clear, that working of the casing part can be carried out e.g. by upsetting retaining shoulders therein by means in the casing shoe or by chipping the casing part in a manner differing from actual threading by planning it with the casing shoe. On the other hand the constructions of the drilling heads being illustrated in the appended drawings may vary in practice very much merely when being carried out with differing diameters. Instead of the type of embodiments shown e.g. in FIGS. 3*a*, 3*b*, 5, 6 and 7, it is naturally possible to use as the drilling device also other drilling devices that are applicable for the same purpose, in which a casing part is being exploited in connection with the drilling that is being drawn into the ground either by rotating the same or unrotatively. It is not that significant for the method and the apparatus according to the invention, either, how the first and second drilling means are coupled to work, so that most heterogeneous solutions can be exploited as the power transmission assemblies between the same starting from a screw joint locking. In the drilling apparatuses exploiting the invention it is possible to exploit most heterogeneous flushing flow arrangements that are carried out both in air operated and in fluid operated manners without hammering motion or exploiting hammering motion etc.

The invention claimed is:

1. A method for plastic pipe drilling when using an apparatus, which has a drilling device, the method comprising:

providing a casing part manufactured from a plastic based material particularly for performing plastic pipe drilling;

providing a drilling unit that is arranged at least during a drilling operation essentially inside the casing part, the drilling unit comprising a first drilling part for drilling a center hole and second drilling part for reaming the center hole for the casing part, the first drilling part and the second drilling part being arranged at a drilling head of the drilling unit and being coupled mutually at least during a drilling operation in a power transmitting manner in order to carry out cooperation thereof for a rotational motion, a feeding motion and/or a hammering motion and removably or in a radially contrastable manner in connection with the casing part in order to enable removal of the first drilling part or the second drilling part together with the casing part from a drilled hole;

mounting a casing shoe at an end of the casing part in order to enable pulling of the casing part into the hole to be drilled by the drilling unit through the casing shoe, wherein the casing shoe is mounted at the end of the casing part for achieving a screw joint between said parts through chipping; and providing the casing shoe with a working member, whereby the casing part is mechanically worked by upsetting or chipping by the working member in order to achieve a joint between the casing part and the casing shoe that transmits pulling in a longitudinal direction(s) of the drilling unit, wherein the drilling head of the drilling unit is formed of a first frame part and a second frame part, wherein drilling surfaces formed of end surfaces of the above frame parts are provided with drilling organs of the first and the second drilling parts, and, whereby the casing shoe is connected with the second frame part when needed by a joint arrangement that enables a mutual rotative motion of the casing shoe and the second frame part and that limits mutual longitudinal movement of the casing shoe, wherein the casing shoe includes a threading end having two or several ends and an exhaust arrangement for removal of chips.

2. The method according to claim 1, wherein in forming an internal or external joint surface with respect to the casing part, the screw joint being made by an internal or external threading sleeve that is arranged in an integral manner at the end of the casing shoe, the sleeve having one or more chip removal grooves or openings.

3. The method according to claim 1, further comprising:

utilizing the working member to mount the casing shoe at the end of the casing part, wherein the working member is configured to perform chipping on a cone screw principle.

4. The method according to claim 1, wherein in the mounting of the casing shoe at the end of the casing part, a threading end is used that is carried out by a machine thread, a square thread or a trapezoidal thread.

5. The method according to claim 1, wherein an essentially unpreworked raw pipe preform is used as the casing part that is manufactured from PEH-, PVC-plastic and/or from reinforced plastic.

6. An apparatus for plastic pipe drilling, the apparatus comprising:

a drilling device comprising a casing part manufactured from a plastic based material particularly for performing plastic pipe drilling and a drilling unit that is arranged at least during a drilling operation essentially inside the casing part, the drilling unit comprising first drilling unit for drilling a center hole and second drilling unit for reaming the center hole for the casing part, the drilling unit and the second drilling unit being arranged at a drilling head of the drilling unit and being coupled mutually at least during a drilling operation in a power transmitting manner in order to carry out cooperation thereof for a rotational motion, a feeding motion and/or a hammering motion and removably or in a radially contractable manner in connection with the casing part in order to enable removal of the first drilling unit or the second drilling unit together with the drilling head from a drilled hole, and whereby a casing shoe is arranged to be mounted at an end of the casing part in order to enable pulling of the casing part into the hole to be drilled by the drilling unit through the casing shoe, wherein the casing shoe comprises a working member for mechanical working of the casing part by upsetting or chipping during mounting thereof with the casing part in order to achieve a joint between the casing part and the casing shoe that transmits pulling in a longitudinal direction(s) of the drilling unit, wherein the drilling head of the drilling unit is formed of a first frame part and a second frame part, wherein drilling surfaces formed of end surfaces of the above frame parts comprise drilling organs of the first drilling part and the second drilling part, and, whereby the casing shoe is connectable with the second frame part when needed by a joint arrangement that enables a mutual rotative motion of the casing shoe and the second frame part and that limits mutual longitudinal movement of the casing shoe, wherein the casing shoe comprises a threading end with at least two ends in order to mount the casing shoe at the end of the casing part for achieving a screw joint between said parts through chipping, whereby the threading end is further provided with exhaust arrangements for removal of chips.

7. The apparatus according to claim 6, wherein the end of the casing shoe comprises an integral internal or external threading sleeve in order to form an internal or external joint surface with respect to the casing part, whereby the threading sleeve comprises at least one chip removal groove or opening.

8. The apparatus according to claim 6, wherein the threading end of the casing shoe comprises a machine thread, a square thread or a trapezoidal thread, and/or wherein the casing part comprises an essentially unpreworked raw pipe preform, which is manufactured from PEH-, PVC-plastic and/or from reinforced plastic.

* * * * *